US006360967B1

(12) United States Patent
Schorn

(10) Patent No.: US 6,360,967 B1
(45) Date of Patent: Mar. 26, 2002

(54) SHOWER HEAD FOR A SANITARY SHOWER

(75) Inventor: Franz Schorn, Schiltach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/531,132

(22) Filed: Mar. 17, 2000

(30) Foreign Application Priority Data

Mar. 18, 1999 (DE) ..... 199 12 104

(51) Int. Cl.[7] ..... B05B 3/04; B05B 3/16
(52) U.S. Cl. ..... 239/240; 239/381
(58) Field of Search ..... 239/381–383, 239/237, 240, 246, 247

(56) References Cited

U.S. PATENT DOCUMENTS 4,018,385 A 4/1977 Bruno ..... 239/102
4,542,853 A * 9/1985 Diamond ..... 239/383
4,802,628 A 2/1989 Dautel et al. ..... 239/227
5,108,035 A * 4/1992 Friedrichs ..... 239/381 X
5,248,092 A * 9/1993 Rankin ..... 239/381 X
5,332,155 A 7/1994 Jäger ..... 239/240

FOREIGN PATENT DOCUMENTS

DE 39 15 962 9/1990
DE 198 30 801 A1 * 1/2000

* cited by examiner

*Primary Examiner*—Lesley D. Morris
(74) *Attorney, Agent, or Firm*—Duane, Morris, LLP

(57) ABSTRACT

A shower head contains in its interior four nozzle elements, whose front ends are mounted in funnel-like openings of the jet disks. The rear ends of the nozzle elements are eccentrically mounted in each case one disk, which can be rotated about a fixed axis with the aid of a turbine wheel. Thus, the nozzle elements out of which the water flows perform a wobbling movement about an axis perpendicular to the jet disk.

14 Claims, 3 Drawing Sheets

SHOWER HEAD FOR A SANITARY SHOWER

Shower heads are known as fixed-installed head showers, side showers or as hand showers at the end of a tube. Numerous different types of jets are known, which can be delivered with such shower heads. Pulsating jets, aerated jets and jets relatively slowly changing their water quantity are known.

The problem of the invention is to provide a shower head, which produces an optically pleasing and pleasant feeling jet pattern.

For solving this problem the invention proposes a shower head having a casing, a jet disk, and at least one jet outlet opening, as well as a drive means, which is constructed for the controlled, continuous modification of the direction of the axis of the outlet opening with respect to the casing. Further developments of the invention form the subject matter of the dependent claims, whose wording, like that of the abstract, are by reference made into content of the description.

Whereas in the known showers the quantity and optionally also the shape of the jet is modified, now for the first time there is also a change to the direction of a water jet delivered by the shower head, namely in a continuous manner. This makes it possible to produce a jet, which in the case of a fixed shower head migrates over the skin of a showering person, e.g. along a closed path. This makes it possible to not only wet a larger area of the body, but also to achieve a massaging effect, but which is different to that in the known massage showers. Thus, the jet does not remain on the same point and instead changes the latter.

According to a further development of the invention the drive means operates during the outflow of water from the jet outlet opening.

It is particularly favourable if the drive means is operated by the flowing water. Consequently no additional devices are required for operating the drive means.

According to a further development of the invention, the direction of the axis of the jet outlet opening is modified in such a way that it is at least partly located on a cone, particularly a circular cone.

Figure 1:
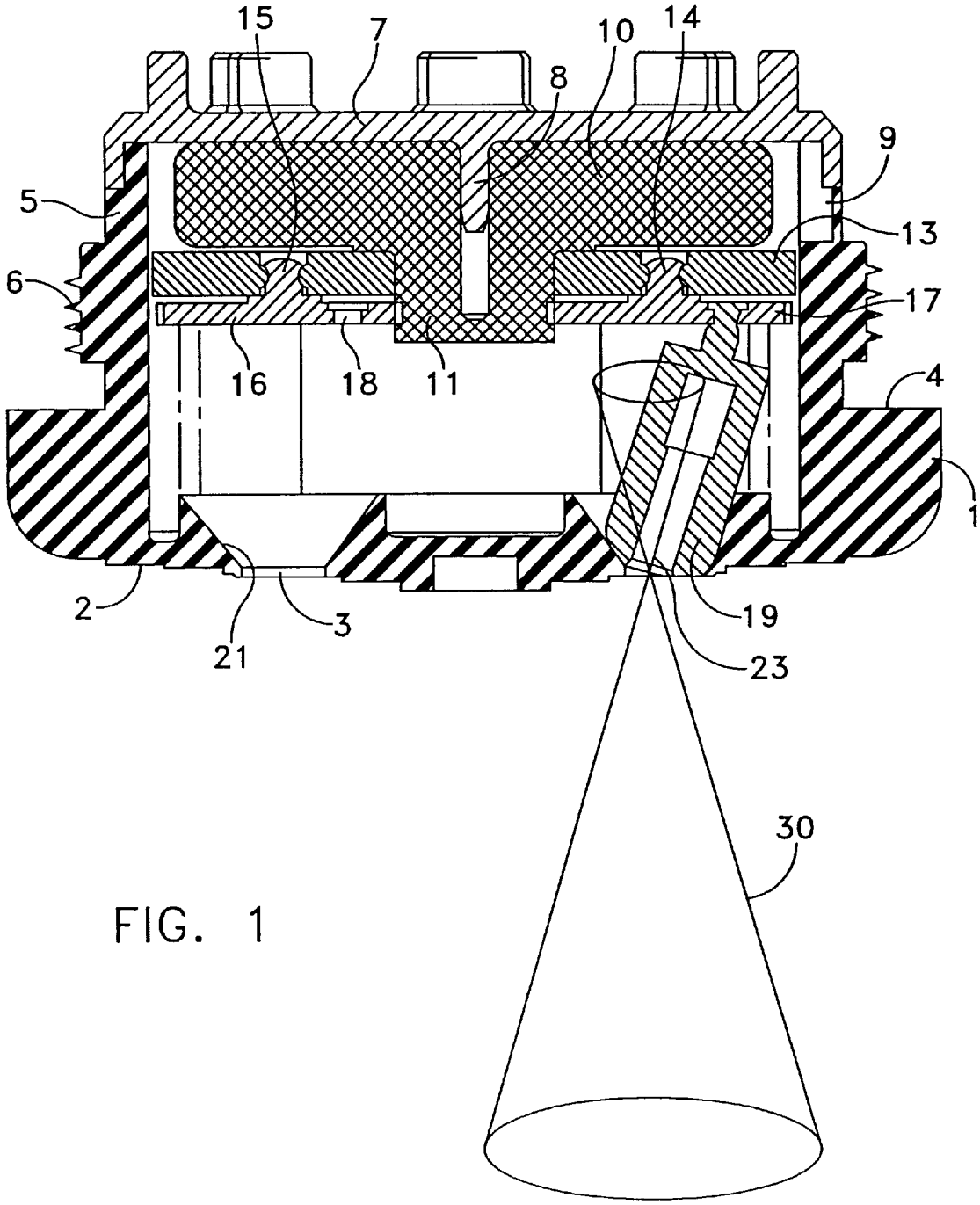

According to the invention it is also possible to move the axis in such a way that it is located on a double cone, as shown in FIG. 1.

The invention proposes that the cone apex is in the vicinity of the jet disk, so that compared with known showers there are only slight changes to the space requirement and appearance of the shower.

According to the invention the jet disk has several jet outlet openings, which can be arranged in a random pattern.

If there are several jet outlet openings, according to the invention the drive means can be constructed in such a way that it modifies the direction of the axis of more than one jet outlet opening. It is obviously also possible to modify the direction for some jet outlet openings, whereas other jet outlet openings deliver a jet in constantly the same direction.

According to the invention the directions of the axis of the several jet outlet openings are synchronously modified. This makes the drive simple, because the movement can be derived from a single drive means.

According to the invention the directions of the axes of the several jet outlet openings are modified in equiphase or in-phase manner, which leads to an optically closed jet pattern.

However, it is also possible to modify the directions in non-equiphase or out of phase manner.

According to the invention the movement can be such that the cone axis about which the jet is pivoted is perpendicular to the jet disk.

For modifying the direction of the jet outlet opening axis it is conceivable to allow the entire jet disk to wobble. The invention proposes placing the jet outlet opening in a nozzle element pivotable with respect to the jet disk, so that the change to the direction of the axis can be carried out by pivoting said nozzle element with respect to the jet disk and therefore also with respect to the casing.

According to a further development of the invention the nozzle element is mounted in an opening of the jet disk, particularly the jet outlet end of the nozzle element. The movement of the nozzle element then takes place within the casing of the shower head. If desired, it is naturally also possible for the jet element to project outwards from the jet disk, so that then the nozzle element movement is visible from the outside.

It is also possible to mount the nozzle element on the jet disk with the aid of elastic devices allowing such a wobbling movement of the nozzle element.

According to the invention it is possible for all the nozzle elements to engage in a common disk which is then e.g., eccentrically mounted on a turbine wheel to provide circular movement without the disk itself being rotated.

According to the invention it is possible for all the nozzle elements to engage in a common disk, which is then e.g. moved eccentrically in a circular movement without itself being rotated.

However, it is particularly favourable if each nozzle element engages in a single disk, which is driven in rotary manner about an axis fixed with respect to the shower head.

A turbine can be used for rotary driving purposes.

Further features, details and advantages of the invention can be gathered from the following description of a preferred embodiment and the attached drawings, wherein show:

FIG. 1 A cross-section through part of a shower head.

Figure 2:
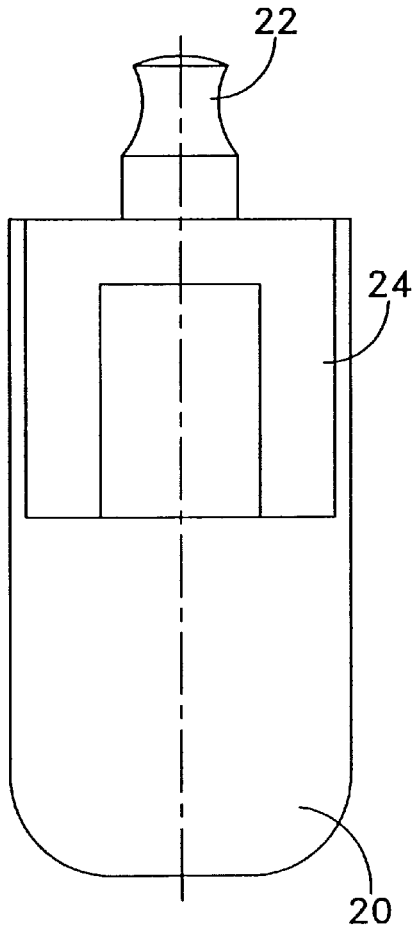

FIG. 2 On a larger scale a side view of a nozzle element.

Figure 3:
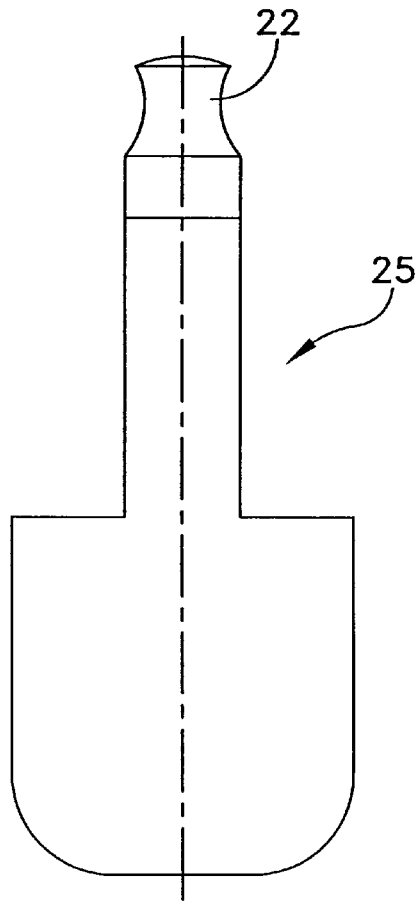

FIG. 3 Another side view of the nozzle element of FIG. 2 from a direction offset by 90°.

Figure 4:
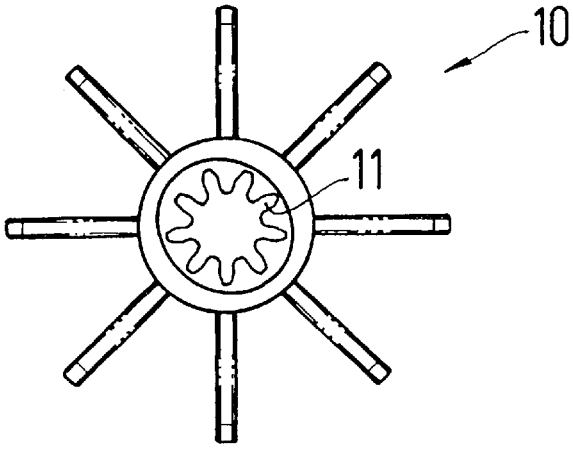

FIG. 4 A plan view on a turbine forming part of the drive means.

Figure 5:
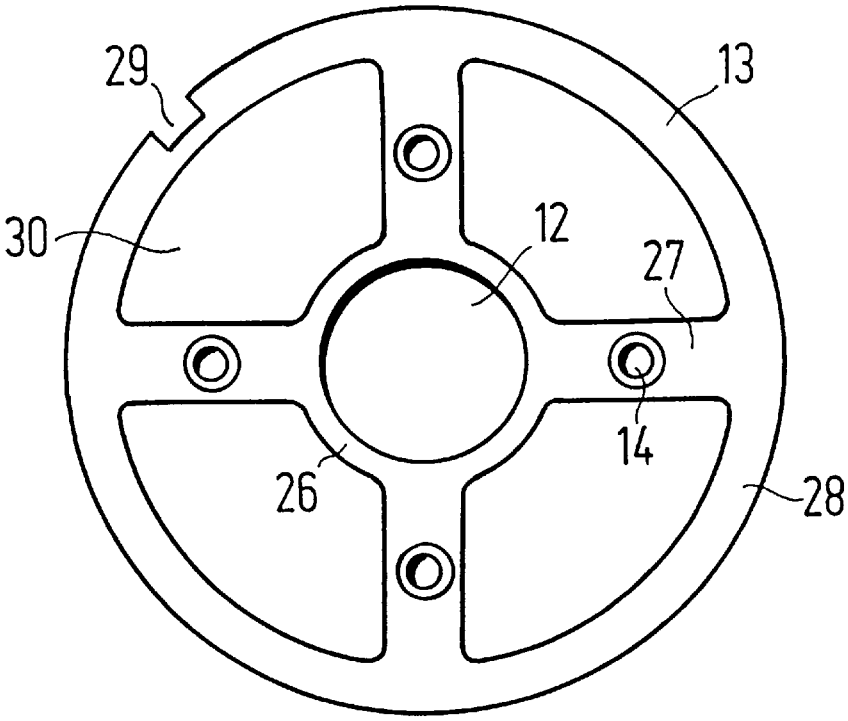

FIG. 5 A plan view of a disk arranged in fixed manner in the casing with a mounting support for four rotatable disks.

FIG. 1 shows a section through part of a shower head. A jet disk I has a slightly convexly shaped outside 2, in which there are several openings 3. On the opposite back 4 of the jet disk 1 is shaped a cylindrical lug 5, which has an external thread 6 for screwing into the casing of a shower head. To the rear the arrangement of the lug 5 is covered by a cap 7, which in its centre has a shaft 8 projecting into the lug 5. At one point on the radial outside of this arrangement is formed an opening 9, through which the water flowing into the shower head can flow from the outside to the inside into the lug 5.

On shaft 8 is mounted a turbine wheel 10, which has a hub 11, which is constructed as a gear, cf. also FIG. 4. With radial spacing the hub 11 engages through a central opening 12 of disk 13, which is mounted in fixed manner in the lug 5 of the jet disk 1. The disk 13 has four holes 14, in which are mounted bearing lugs 15 of disks 16. With the aid of the bearing lugs 15 the disks 16 are rotatable with respect to the disk 13. In the vicinity of their circumference the disk 16 have a tooth system 17 engaging in the toothed hub 11.

Thus, on rotating the turbine wheel 10 the disks 16 are rotated. Each disk 16 has an opening 18, which revolves along a circle on rotating the disks 16.

In the represented embodiment there are four nozzle elements 19 between the disks 16 and the inside of the jet disk 1. The rounded front 20 of each nozzle element 19 engages in a funnel-like recess 21 positioned behind the openings 3. The thickness of the jet disk I in the vicinity of the opening 3 is chosen in such a way that the nozzle elements 19 cannot slide out of the funnel 21.

In the vicinity of its end remote from the front 20 the nozzle elements 19 have a bearing lug 22, which is inserted in the openings 18 of the disk 16.

These bearing lugs 15 of the disks 16 are arranged in axial extension of the centre of the openings 3 of the jet disk 1. Thus, on rotating the disks 16, the nozzle elements are pivoted about the connecting line between the bearing lugs 15 and the centre of the opening 3 in a wobbling movement.

The nozzle elements 19 have an axially directed opening 23, whose front forms the jet outlet opening. In accordance with FIG. 3, the nozzle elements 19 are laterally open roughly at half the length of the longitudinal extension thereof, so that the part of the nozzle elements 19 facing the turbine wheel 20 is shaped like a clip 24. Thus, from the two open sides 25 water can flow out of the shower head into the nozzle elements 19 and leave the latter through the front end. The axis of the openings 23 consequently forms the axis along which the water jet flows out.

FIG. 5 shows the disk 13 arranged in fixed manner in the casing and which is constructed as a wheel. Around the central opening 12 is formed a ring 26, from which four spokes 27 lead to the outside. On the outside there is once again a ring 28, which has a notch 29 at one point. The notch 29 serves for the positionally correct fixing of the disk 13 in the casing.

Roughly centrally in the radial direction the spokes 27 contain the openings 14 forming the mounting support for the gears 16.

If water flows through the opening 9 into the interior of the lug 5, it firstly drives the turbine wheel 10. Simultaneously water flows through the gaps 30 between the spokes 27 of the disk 13 to the nozzle elements 19 and from there through the openings 23 thereof to the outside. The rotation of the turbine wheel 10 leads to a rotation of the disks 16 about the fixed axes. The rotation of the disks 16 leads to the aforementioned wobbling movement of the nozzle elements 19. This means that the direction of the jets passing out of the shower head is continuously modified and namely in the represented embodiment along a circular cone, whose apex is roughly located in the jet disk 1. All the nozzle elements 19 are moved at the same angular velocity.

What is claimed is:

1. Shower head, comprising:

a casing, a jet disk, at least one jet outlet opening, and a drive means constructed for controlled, continuous modification of a direction of an axis of the outlet opening with respect to the casing;

wherein the direction of the axis is modified such that the axis is at least partly located on a cone;

wherein the jet outlet opening is formed by a nozzle element that is pivotable with respect to the jet disk; and, wherein the nozzle element engages in a vicinity of its rear end, in a disk movable by the drive means.

2. Shower head according to claim 1, wherein the drive means operates during overflow of water from the jet outlet opening.

3. Shower head according to claim 1, wherein the drive means is operated by flowing water in the shower head.

4. Shower head according to claim 1, wherein the axis is moved such that the axis is located on a double cone.

5. Shower head according to claim 1, in which the cone has an apex in a vicinity of the jet disk.

6. Shower head according to claim 1, having a plurality of said jet outlet openings.

7. Shower head according to claim 6, wherein the drive means is constructed so as to modify the direction of the axis of more than one of said jet outlet openings.

8. Shower head according to claim 7, wherein the directions of the axes of several of said jet outlet openings are modified synchronously.

9. Shower head according to claim 7, wherein the directions of the axes of several of said jet outlet openings are modified in equiphase manner.

10. Shower head according to claim 1, wherein the cone has an axis perpendicular to the jet disk.

11. Shower head according to claim 1, wherein the nozzle element is mounted in a funnel-like opening of the jet disk.

12. Shower head according to claim 1, wherein all the nozzle elements for a plurality of said jet outlet openings engage in a common disk.

13. Shower head according to claim 1, wherein the nozzle element engages in an individual disk driven in rotary manner about a fixed axis.

14. Shower head according to claim 1, wherein the axis of the outlet opening is at least partly located on a circular cone.

* * * * *